US006220459B1

(12) United States Patent
Runyon

(10) Patent No.: US 6,220,459 B1
(45) Date of Patent: Apr. 24, 2001

(54) SAXOPHONE STAND

(76) Inventor: Clinton A. Runyon, 174 Emerite Dr., Lafayette, LA (US) 70518

( * ) Notice: Subject to any disclaimer, the term of this patent is extended or adjusted under 35 U.S.C. 154(b) by 0 days.

(21) Appl. No.: 09/452,621

(22) Filed: Dec. 1, 1999

(51) Int. Cl.[7] ..... A47F 7/00

(52) U.S. Cl. ..... 211/85.6; 211/195; 84/327; 84/385 A; 248/166; 248/176.1

(58) Field of Search ..... 211/85.6, 195; 84/327, 387 A, 385 A; 248/158, 160, 166, 176.1

(56) References Cited

U.S. PATENT DOCUMENTS

| | | | | |
|---|---|---|---|---|
| 1,464,279 | * | 8/1923 | Hindley . | |
| 1,612,148 | * | 12/1926 | Oettinger . | |
| 1,646,165 | * | 10/1927 | Naujoks et al. . | |
| 1,661,805 | * | 3/1928 | Lentaty . | |
| 1,900,718 | * | 3/1933 | Lang . | |
| 2,262,556 | * | 11/1941 | Richmond . | |
| 4,036,462 | * | 7/1977 | Sheftel | 248/166 |
| 4,145,950 | | 3/1979 | Glantz . | |
| 4,187,947 | | 2/1980 | Dunn . | |
| 4,407,182 | | 10/1983 | Blasini . | |
| 4,572,050 | | 2/1986 | Werner . | |
| 4,695,022 | | 9/1987 | Mendonsa et al. . | |
| 4,926,735 | * | 5/1990 | Smith | 84/387 A |
| 4,986,158 | * | 1/1991 | Johnson | 84/327 |
| 5,165,634 | * | 11/1992 | Garbuzov et al. | 248/166 |
| 5,253,563 | | 10/1993 | Smith . | |

* cited by examiner

*Primary Examiner*—Robert W. Gibson, Jr.
(74) *Attorney, Agent, or Firm*—Robert N. Montgomery

(57) ABSTRACT

An improved saxophone stand for preventing accidental damage due to rotation of the instrument while on the stand, the stand including a relatively lightweight, aluminum or polymeric , structural bar base supporting a vertical member and a pivotal diagonal support member further utilizing extended "U" shaped or "J" shaped support members, attached to the diagonal support member, at least one of which is slidably adjustable and partially surrounding both the instrument's bell portion and the principle body portion thus resisting rotation of the instrument within the stand's "U" shaped support members. A further embodiment discloses the capability of connecting a plurality of stands together as well as removable and interchangeable vertical column and disk members for supporting other wind instruments such as flute and or clarinet .

19 Claims, 5 Drawing Sheets

SAXOPHONE STAND

BACKGROUND OF THE INVENTION

1. Field of the Invention

This invention relates generally to musical instrument stands in general and more particularly to an improved portable saxophone stand.

2. General Background

Generally musicians utilize instrument stands of some description to support their instruments when not in use. Such stands typical of wind instrument stands are disclosed in U.S. Pat. Nos. 4,187,947, 4,572,050, 5,253,563, 4,407,182, 4,695,022 and 4,145,950. However, only the 4,572,050 and 4,187,947 patent disclose designs that include accommodations for saxophones. The need to support such wind instruments is widely accepted, as well as the need to prevent damage to the instrument should the instrument be tipped over. However, other than providing a larger or more sturdy base for the stand and perhaps providing a break away peg attached to a flat support as suggested by the 4,145,959 patent, little has been done to prevent instrument damage.

Saxophones, due to their particular configuration, are most often damaged as a result of being tipped over while on a stand. However, the stand need not necessarily tip over to cause damage to the instrument. The saxophone need only rotate within the confines of the stand's support members, causing damage to the keys, or contact an adjacent instrument to cause damage to the instrument. As indicated by the prior art disclosed in U.S. Pat. Nos. 4,572,050 and 4,187,947, saxophones can be either supported when not in use or used for strapless support while playing. In either case the instrument must be readily accessible or repeatedly removable from the stand, if required, without damage to the instrument. As discussed by the prior art and or acknowledged by the art in general, the instrument stand should be sturdy, compact, stable, light weight and collapsible for easy portability. Prior art saxophone stands in particular fail to provide many of these features by being top heavy with the instrument in place, require attendance at all times, or place severe stress on the structural elements of the instrument as is the case in U.S. Pat. No. 4,187,947 where the full weight is place on the rim of the bell mouth portion of the instrument. In this case, if the instrument is struck, severe damage to the bell mouth will occur regardless of any other damage. It should be noted that the saxophone in this case is allowed to rotate on the stand and in doing so causes damage to the rim. The U.S. Pat. No. 4,572,050 patent discloses a stand for supporting the instrument while playing thus, by necessity, the instrument must rotate in the support elements. In this case he instrument is off balance and subject to tipping if left unattended. It is therefore the principle object of the present invention to provide a wind instrument stand especially for saxophones which prevents accidental rotation of the instrument relative to instrument's support members. .

Another object is to provide a stable, and portable instrument stand that is both light weight and collapsible.

Still another object is to provide a stand with ability for connecting a plurality of stands and adapting such stands for use with a plurality of instruments.

SUMMARY OF THE INVENTION

The present invention discloses an improved saxophone stand for preventing accidental damage to the instrument due to rotation of the instrument while on the stand. The stand being stable, lightweight, collapsible and configurable to accommodate a plurality of other wind instruments. The stand including a relatively lightweight, aluminum, structural bar base supporting a vertical member and a pivotal diagonal support member. The saxophone stand further utilizing extended "U" shaped or "J" shaped support members, attached to the diagonal support member, at least one of which is slidably adjustable relative to the diagonal support member and partially surrounds both the instrument's bell portion and the principle body portion, thus resisting rotation of the instrument within the stand's "U" or "J" shaped support members. A further embodiment discloses the capability of connecting a plurality of stands together, as well as removable and interchangeable vertical column and disk members for supporting other wind instruments such as flute and or clarinet .

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
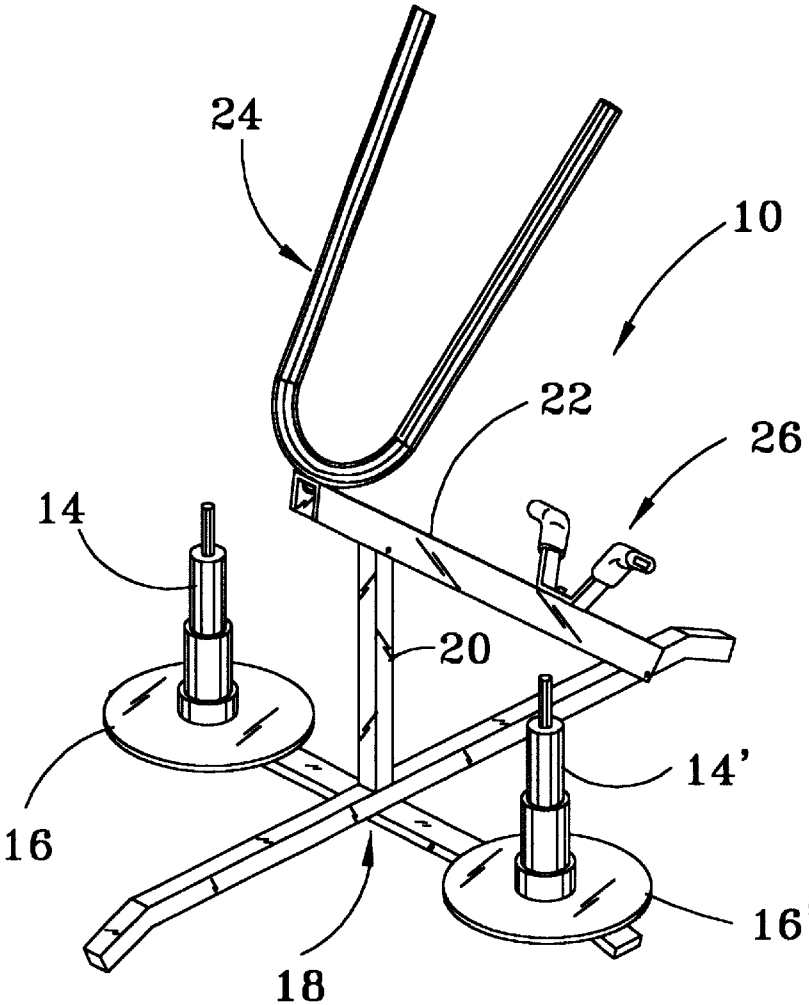
FIG. 1 is an isometric view of the preferred saxophone stand embodiment.
Figure 7:
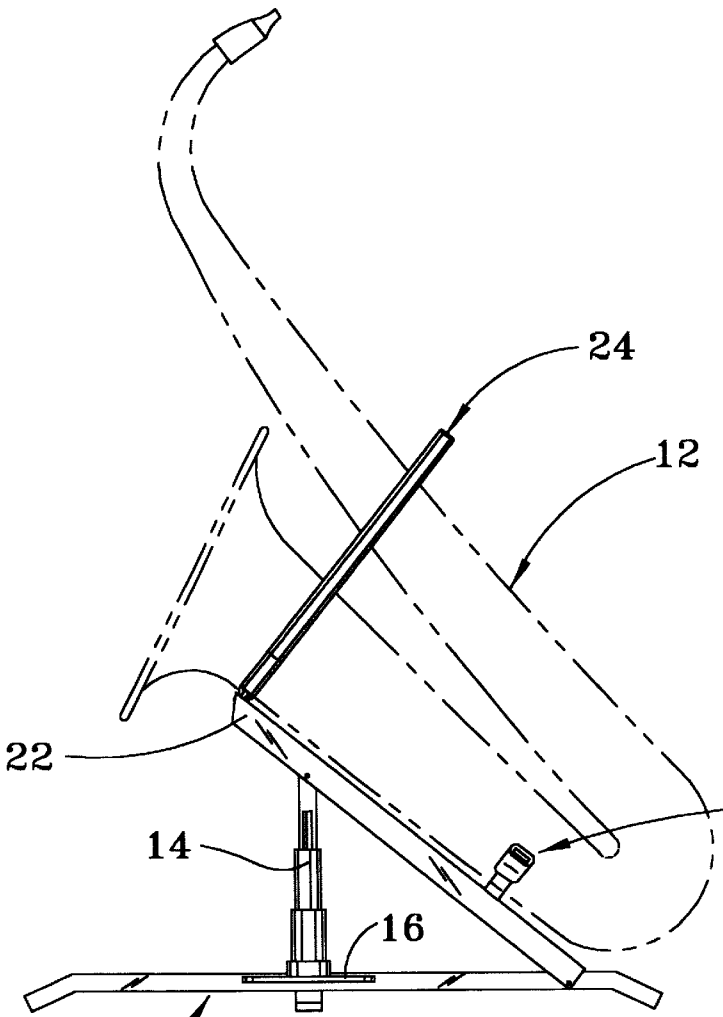
FIG. 7 is the side elevation view of the embodiment shown in FIG. 1.

As first seen in FIG. 1, the preferred embodiment 10 is an instrument stand primarily for supporting a saxophone 12 in the manner illustrated in FIG. 7 and includes vertical columns 14 and disk members 16 on either side of instrument stand base for supporting other wind instruments, such as the flute and clarinet. The stand 10 includes a base frame assembly 18, a vertical post 20 and a diagonal bar 22 having upper and lower instrument support members 24,26.

Figure 2:
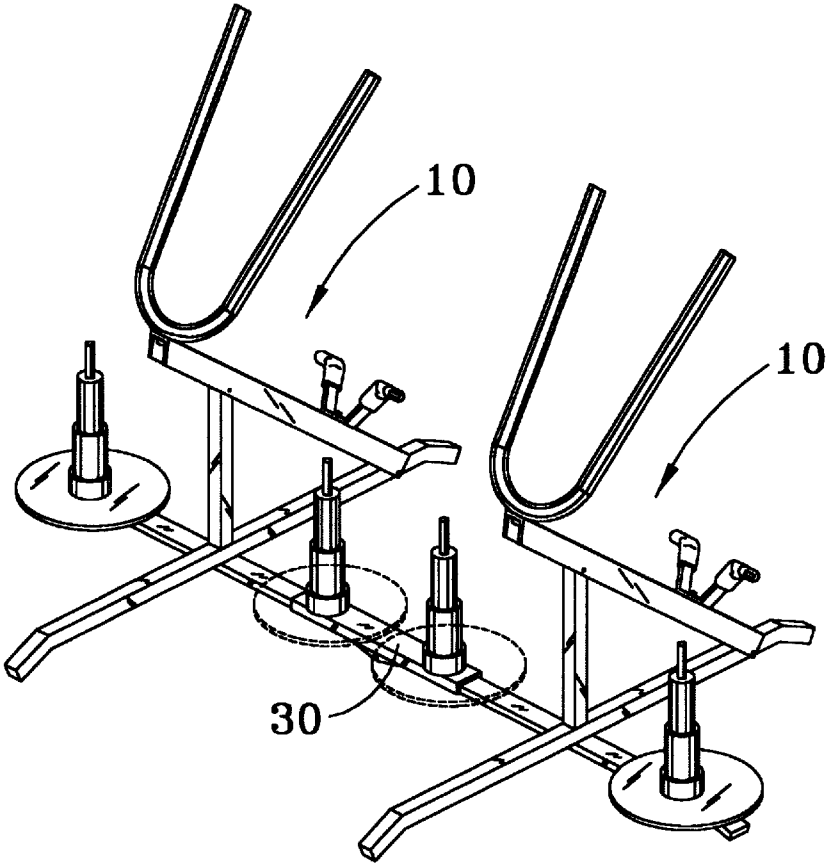
FIG. 2 is an isometric view of an alternate embodiment linking two of the stands shown in FIG. 1
Figure 4:
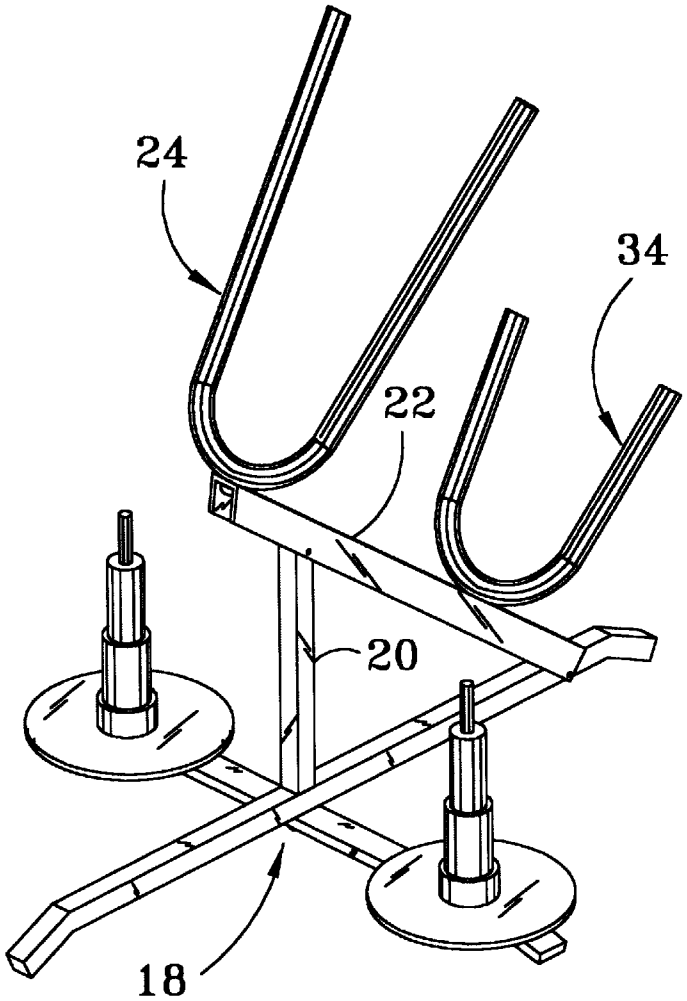
FIG. 4 is an isometric view of an alternative embodiment of the stand shown in FIG. 1.
Figure 3:
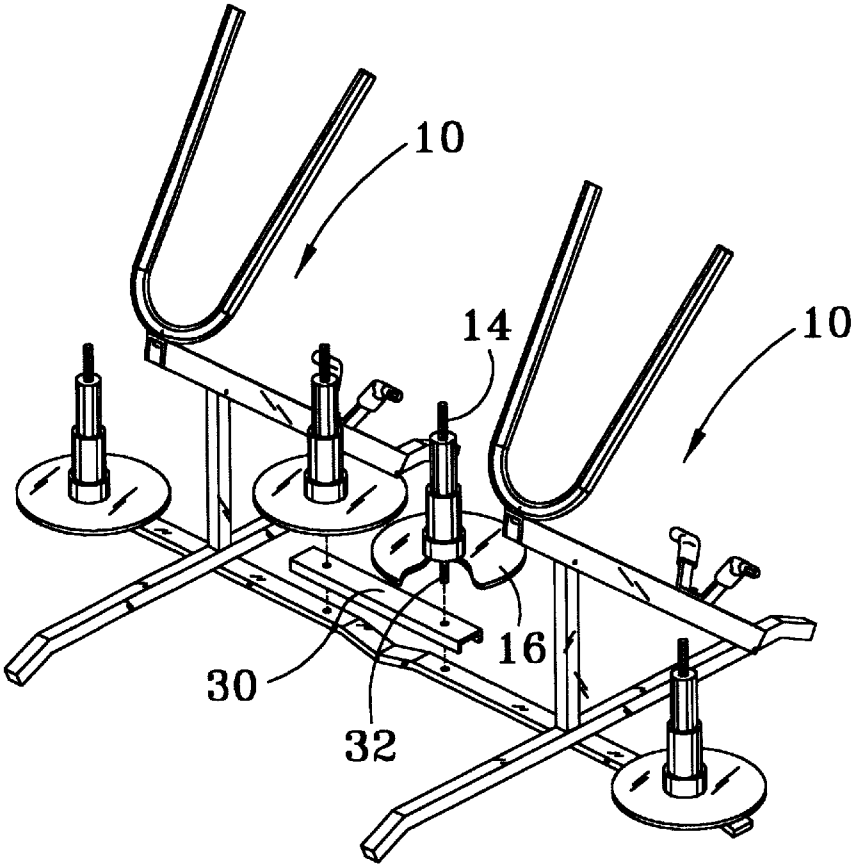
FIG. 3 is a partially expanded isometric view of an alternate embodiment linking two of the stands shown in FIG. 1.
Figure 5:
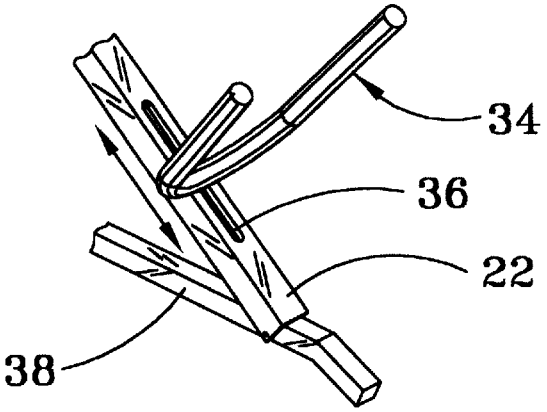
FIG. 5 is a partial detailed, isometric, view of the embodiment shown in FIG. 4.

As seen in FIG. 2, any combination of the stands 10 may be attached by utilizing a bridge channel member 30 best seen in expanded view FIG. 3. The bridge 30 is secured in position by studs 32 extending from the vertical columns 14 which pass through both the disk 16 and bridge 30 and thereby engage the base frame 18. Looking now at FIG. 4, it is seen that the lower instrument support member 26 seen in FIG. 1 and 2 has been replaced by an extended arm support member 34, thereby insuring that the instrument 12 cannot be accidentally dislodged from the lower support 34. The lower instrument support 34 is also infinitely adjustable longitudinally along a slot as seen in FIG. 5.

Figure 6:
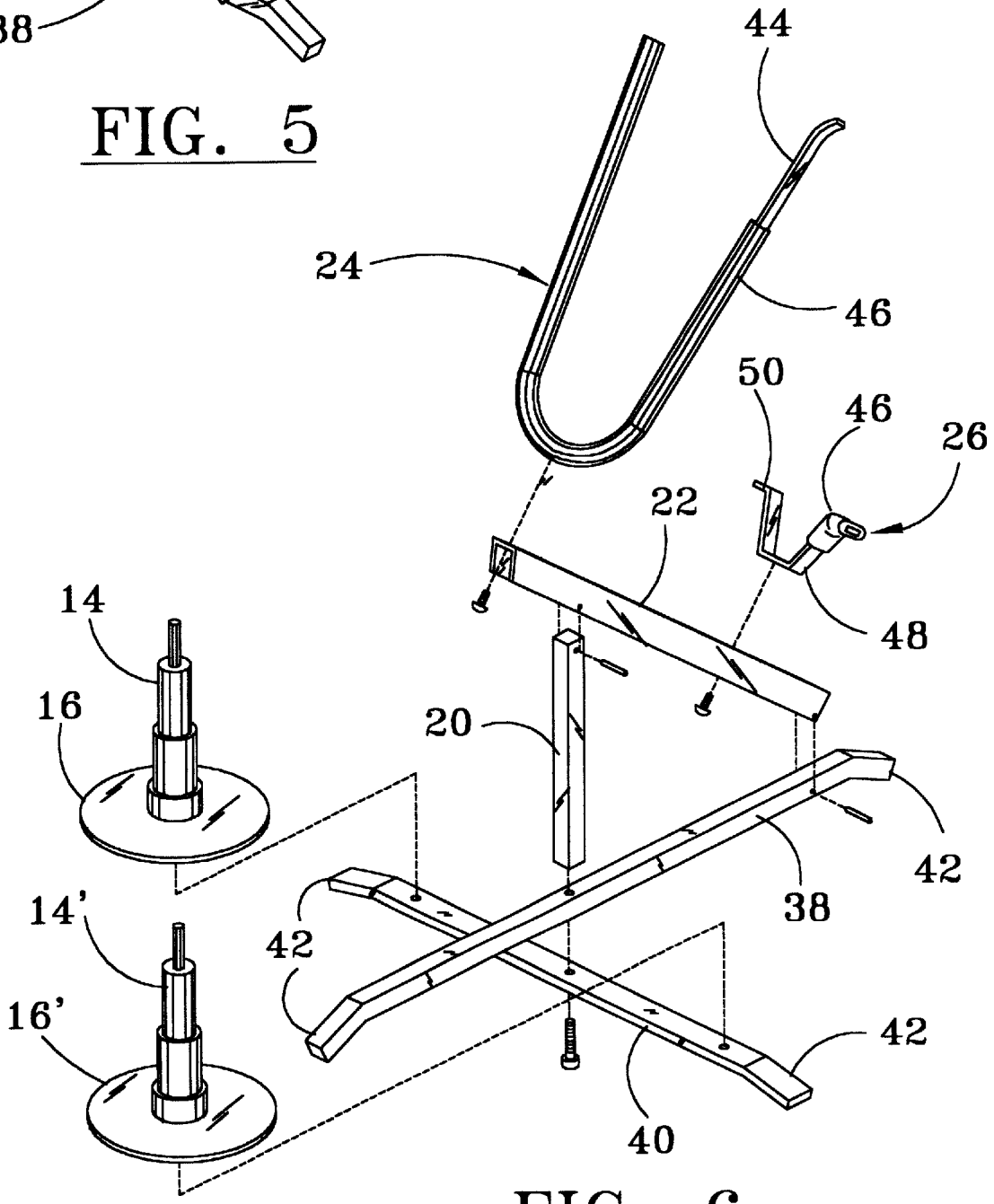
FIG. 6 is an isometric exploded view of the embodiment shown in FIG. 1.
Figure 8:
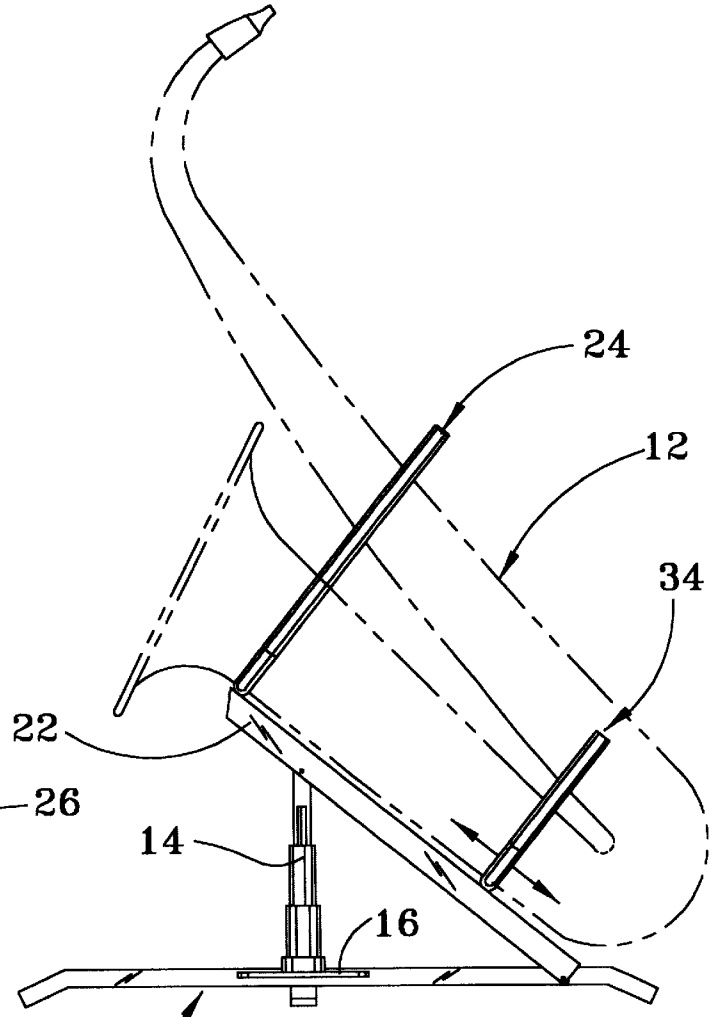
FIG. 8 is the side elevation view of the embodiment shown in FIG. 4.

As seen in FIG. 6, the preferred embodiment illustrated in FIG. 1 is constructed and assembled by first forming a strong but light weight base assembly 18 from a material such as aluminum or a polymeric material. The base frame 18 includes two horizontal members centrally attached forming an approximate right angle, one member 38 having a box shaped cross section, the second member 40 having a generally flat bar or rectangular configuration. Each member having an offset or diagonally bent portion 42 at each end. The base 18 is then assembled by passing a screw through both the horizontal members 39,40 and threadably engaging an end of vertical post member 20. The horizontal bar 40 is tapped adjacent each end to threadably receive the studs 30 mentioned above located in the lower end of vertical instrument support members. The diagonal channel bar 22 is pivotally pined to the upper end of the vertical post 20 adjacent one end and pivotally pined to the base member 38 at the opposite end. Upper and lower support members 24, 26 or the alternate support member 34 are then secured to the diagonal bar 22. The upper instrument support bar and optional lower support 34 are simply "U" shaped flat bars 44, having a rectangular cross section, with extended arms to prevent rotation of the saxophone relative to the stand. The support bar 44 is covered with a polymeric tubing 46 to prevent marring of the instrument 12. The lower support member 26 illustrated in FIG. 6 is a "V" shaped flat bar 48 having turned out leg portions 50 and polymeric tubing liners 46. The saxophone may be supported using the preferred embodiment detailed in FIG. 1 or equipped with lower adjustable support 34 in the manner shown in FIG. 8

Figures 9, 10, 11:
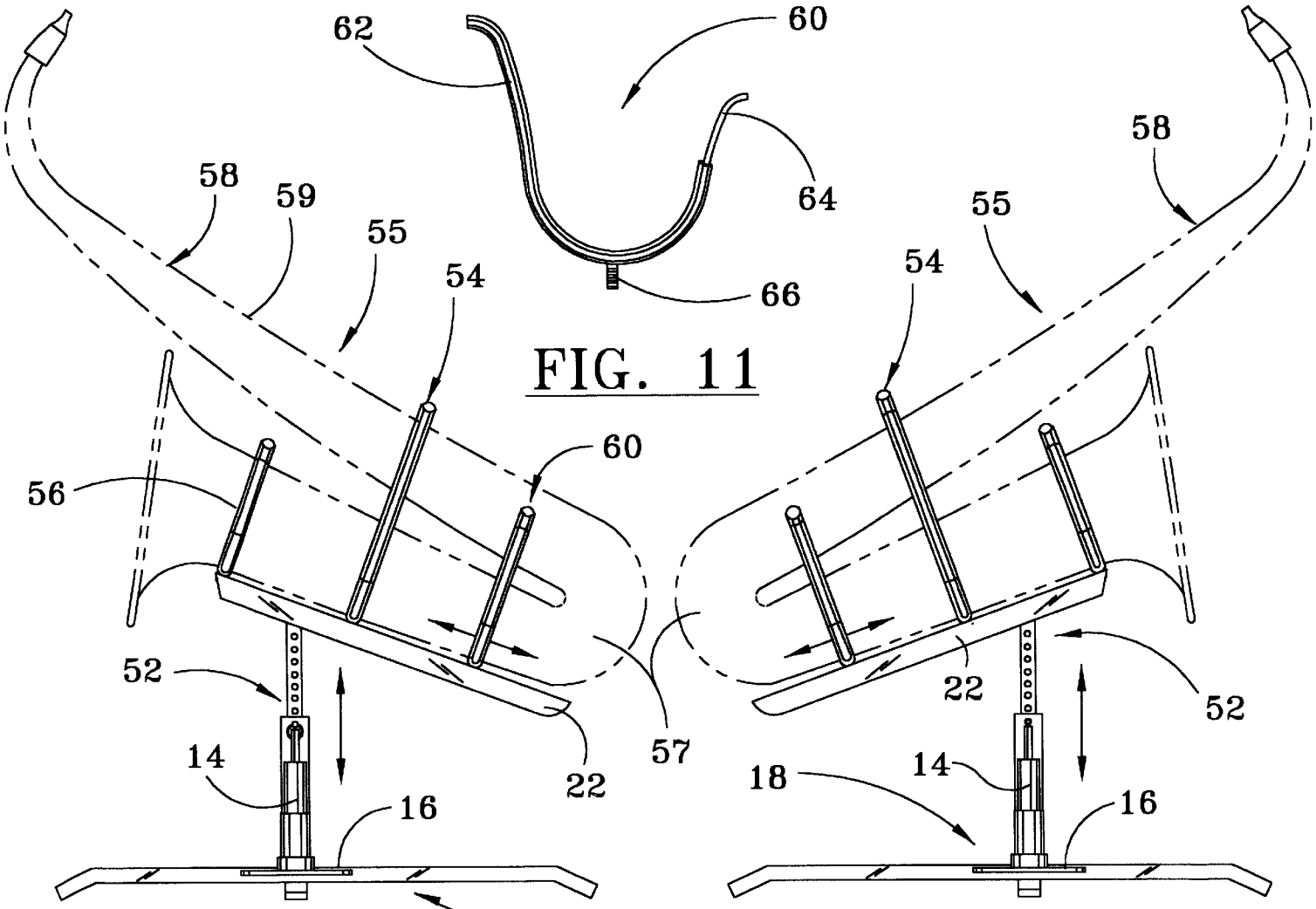
FIG. 9 is a left side elevation view of an alternate embodiment.
FIG. 10 is a right side elevation view of the alternate embodiment shown in FIG. 9.
FIG. 11 is a side elevation of the lower adjustable "U" shaped support member.

An alternate embodiment may be provided for use with the larger baritone saxophones as shown in FIG.'s 9 and 10. In this case it may be necessary to elevate the stand to accommodate the player and allow the instrument to be played while on the stand due to its weight. Therefore, the base assembly 18 remains the same. However, in this case, an incrementally adjustable, telescopic, vertical post assembly 52 is substituted for the normal vertical post 20 used in the preferred embodiment. Furthermore, in this case the diagonal bar 22 is not attached to the base member 44 as shown in FIG. 6 but instead is rigidly fixed to the telescopic vertical assembly. The diagonal bar 22 is also fitted with an intermediate instrument support member 54 constructed in the same manner as support member 24. The upper instrument support member 56 is a shortened version of the support member 24 and only accommodates the bell portion of the baritone saxophone instrument 58. The lower support member 60 is configured as seen in FIG. 11 in a "J" shape, having a long ear portion 62 and a short ear portion 64 and having a threaded stud 66 attached for adjustable attachment to the diagonal bar 22. The long ear 62 of the support member 60 extends upwards on the left side of the instrument as seen in FIG. 9 to include both the bell portion 57 and at least a portion of the main body portion 59 of the instrument 58, while the short ear 64 of the rear instrument support 60 extends upwards to include at least a portion of only the bell portion 57. It is anticipated that the stand configurations 10 and 55 may be disassembled and boxed for transport or may be further configured for collapsibility as a unit for quick assembly.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A portable saxophone stand comprising:

a) a base assembly comprising horizontal, centrally crossed first and second members;

b) a vertical post member centrally located at a juncture of said crossed first and second members;

c) a diagonal member attached to said vertical post member; and d) a plurality of shaped instrument support members attached perpendicular to said diagonal member, at least one of which is capable of partially surrounding both bell and body portions of a saxophone.

2. The saxophone stand according to claim 1 wherein said stand further comprises at least one vertical, column threadably attached adjacent at least one end of said second crossed member, said vertical, column being capable of insertion into a bell portion of a wind instrument and thereby supporting said instrument in a vertical position.

3. The saxophone stand according to claim 2 wherein said at least one vertical column members further comprises, a disk located between said vertical column and said second crossed member.

4. The saxophone stand according to claim 1 wherein said diagonal member is attached to said vertical post and to said first horizontal crossed member.

5. The saxophone stand according to claim 1 wherein at least one of said instrument support members is slidably adjustable relative to said diagonal member.

6. The saxophone stand according to claim 1 wherein said vertical post is telescopically adjustable.

7. The saxophone stand according to claim 1 wherein said instrument support members are "U" shaped.

8. The saxophone stand according to claim 1 wherein at least one of said instrument support members is "J" shaped.

9. The saxophone stand according to claim 1 wherein said instrument support members are covered with polymeric tubing.

10. The saxophone stand according to claim 1 wherein said centrally crossed members are bent downwardly at each end.

11. The saxophone stand according to claim 3 wherein said disk is transparent.

12. The saxophone stand according to claim 1 wherein said stand further includes a connecting means for attaching a plurality of said saxophone stands one to another utilizing threadable attachment of said vertical column for securing said connecting means to said second cross members of each said stand .

13. The saxophone stand according to claim 12 wherein said connecting means is a channel member having holes therein.

14. A portable saxophone stand comprising:

a) a base assembly comprising horizontally, centrally crossed, base members;

b) a vertical, telescopic post member located perpendicular to and at intersection of said crossed, base members;

c) a diagonal member attached to said vertical telescopic post member; and d) a plurality of arcuate shaped instrument support members attached perpendicular to said diagonal member, at least one of which is capable of partially surrounding both bell and body portions of said saxophone.

15. The portable saxophone stand according to claim 14 wherein said stand further comprises:

a) at least one polymeric, vertical column having a plurality of step portions of differing diameters;

b) a threaded stud extending from one end of said vertical column for threadably engaging one of said horizontal crossed base members; and c) a disk having a central hole therein located rotatable on said threaded stud.

16. The portable saxophone stand according to claim 14 wherein at least one of said arcuate shaped support members is "J" shaped.

17. A method for preventing the accidental rotation of a saxophone while supported on an instrument stand comprising the steps of:

a) providing an instrument stand comprising a saxophone stand having first and second horizontally crossed members and a vertical support post extending upwardly from a juncture of said first and second crossed members, a diagonal support member fitted with a plurality of arcuate shaped instrument support members extending perpendicular to said diagonal support member said diagonal support member being supported at one end by said vertical support post with the opposite end of said diagonal member attached to said first horizontal crossed member forming an acute angle between said vertical support post and said diagonal support member;

b) replacing at least one of said arcuate shaped instrument support members with an arcuate shaped instrument support member that partially surrounds both the bell and body portions of a saxophone when being supported by said stand.

18. The method for preventing the accidental rotation of a saxophone while supported on an instrument stand according to claim 17 further comprising the steps of:

a) providing a channel means for attaching a plurality of said stands one to another with instrument support members comprising a column having a plurality of steps of differing diameters and a disk member; and b) slotting said diagonal support member and adapting at least one said instrument support member to be adjustable longitudinally relative to said diagonal support member.

19. The method for preventing the accidental rotation of a saxophone while supported on an instrument stand according to claim 18 further comprising the steps of: configuring the adapted adjustable instrument support in a "J" shape and slidably positioning said adjustable support in a manner wherein said support member does not interfere with the playing of the saxophone while on the stand.

* * * * *